United States Patent [19]

Sachleben, Sr.

[11] 4,212,606

[45] Jul. 15, 1980

[54] QUENCH STACK REEL ASSEMBLY AND CLAMPING DEVICE

[75] Inventor: Harold G. Sachleben, Sr., Bellmawr, N.J.

[73] Assignee: Allied Chemical Corporation, Morris Township, Morris County, N.J.

[21] Appl. No.: 909,427

[22] Filed: May 25, 1978

[51] Int. Cl.[2] ..... B29C 25/00

[52] U.S. Cl. ..... 425/72 S; 264/176 F; 269/228; 292/113; 425/74

[58] Field of Search ..... 264/176 F; 425/72 S, 425/73-75, 382.2; 292/113; 269/228

[56] References Cited

U.S. PATENT DOCUMENTS

| | | | |
|---|---|---|---|
| 1,006,347 | 10/1911 | Belsvig | 292/247 |
| 2,551,684 | 5/1951 | Lodge | 425/72 S |
| 2,636,217 | 4/1953 | Hammond et al. | 425/72 S |
| 2,679,417 | 5/1954 | Seibert | 292/247 |
| 2,697,251 | 12/1954 | Bauer | 425/72 S |
| 2,947,029 | 8/1960 | Bakker | 425/72 S |
| 3,127,203 | 3/1964 | Griffiths et al. | 292/113 |
| 3,234,596 | 2/1966 | Sims | 264/176 F |
| 3,238,562 | 3/1966 | Steidlinger | 425/72 S |
| 3,257,487 | 6/1966 | Dulin | 264/176 F |
| 3,259,411 | 7/1966 | Griffiths | 292/113 |
| 3,264,389 | 8/1966 | Sims | 264/176 F |
| 3,619,452 | 11/1971 | Harrison | 264/176 F |
| 3,664,782 | 5/1972 | Nevin | 425/71 |
| 3,684,416 | 8/1972 | Lenk | 425/72 S |
| 3,782,712 | 1/1974 | Blatt | 269/228 |
| 3,792,853 | 2/1974 | Blatt | 269/228 |
| 3,831,224 | 8/1974 | MacMaster et al. | 24/68 T |
| 3,854,692 | 8/1974 | Milton et al. | 249/194 |
| 3,861,926 | 8/1974 | Sendoykas et al. | 269/228 |
| 3,996,732 | 12/1976 | Foster | 57/122 |
| 4,049,301 | 9/1977 | Schenk | 292/113 |
| 4,065,829 | 1/1978 | Lautenschlager | 16/145 |

FOREIGN PATENT DOCUMENTS

| | | |
|---|---|---|
| 2537336 | 4/1976 | Fed. Rep. of Germany . |
| 1354672 | 5/1974 | United Kingdom . |
| 1415242 | 11/1975 | United Kingdom . |

OTHER PUBLICATIONS

"Clamping, Fixing, Processing, OEM Toggle Clamps" De-Sta-Co., Dover Corp., Detroit, Michigan, 3 pages.

*Primary Examiner*—Jay H. Woo

*Attorney, Agent, or Firm*—Virginia S. Andrews; Richard A. Anderson

[57] ABSTRACT

Apparatus is disclosed for bringing into proximity and connecting a quench stack and monomer ring for the melt spinning of synthetic polymer fibers. These members are brought into proximity through use of a reel assembly and are connected by means of a clamping device. The clamp, which is mounted on the quench stack, features a drawpiece comprising a rod. The rod is curved into a "U" shape, the base of which engages with a keeper element and the legs of which describe a circle bend prior to terminating in a threaded shank for mounting to the clamp.

4 Claims, 6 Drawing Figures

QUENCH STACK REEL ASSEMBLY AND CLAMPING DEVICE

BACKGROUND OF THE INVENTION

1. Field of the Invention

This invention relates to apparatus for the bringing into proximity and connecting of two members, such as chambers. Particularly, it relates to a lift reel and clamping device for coupling or connecting a quench stack to a monomer ring during the melt spinning of synthetic polymer fibers.

2. Description of the Prior Art

In a typical melt spinning process, one or more filaments extrudes from one or more spinnerettes and passes into a quenching chamber for cooling. The equipment utilized in the basic process may vary, depending on the polymer to be melt spun. Thus, in the melt spinning of filaments from polyamide, a monomer ring is interposed between the spinnerette and quench stack. The function of the monomer ring is to efficiently and continuously remove by aspiration volatilized monomer from the vicinity of the spinnerette without adversely affecting yarn quality or the spinning process. An example of such apparatus is disclosed by U.S. Pat. No. 3,257,487 to Dulin, Jr., hereby incorporated by reference. The quench stack is coupled or connected to the monomer ring and sealed with a sealing member, e.g., a silicone salve, interposed between their respective peripheries to form an airtight seal during operation. In order to provide for periodic inspection and maintenance of the spinnerette and associated monomer ring, the quench stack is designed to drop vertically when uncoupled from the monomer ring. Exemplary of such a quench stack is the apparatus of U.S. Pat. No. 3,619,452 to Harrison, hereby incorporated by reference. Unfortunately, when the quenck stack is uncoupled from the monomer ring, the sealing member cools. After the quench stack and monomer ring are recoupled, the member will become plastic or soft due to process temperatures. In order to provide the most efficient seal possible, therefore, it is desirable to have some way of coupling the quench stack and monomer ring which will draw them closer together when the member therebetween has softened sufficiently to permit the same. Such a coupling device, of course, would have utility in conjunction with differently designed spinning equipment, the main function of such a device being the ability to draw up over a variable distance. For instance, the quench stack could be coupled directly to a spinning chamber with no monomer ring, or the quench stack could be hingeably attached on one side and drop away from the monomer ring or spinning chamber.

In addition to the aforementioned process problem, a further problem has been encountered in the use of silicone salve as the sealing member. The upper rim of the quench stack ordinarily has a groove in which the salve is placed. When the monomer ring and quench stack are disconnected and the quench stack drops away to permit access to the spinnerette and monomer ring, some of the salve clings to the lower rim of the monomer ring. This salve, due to the high process temperatures of as much as 260° C., is so hot that it can, and frequently does, drip off the monomer ring to burn the operator who is inspecting the spinnerette and/or monomer ring.

A further problem encountered in the utilization of a quench stack as first described, i.e., one which drops vertically, is the prevalence of back injuries in production operators. Such a quench stack, which weighs up to 57 pounds, must be manually lifted, vertically, in order to bring it close enough to the monomer ring to permit coupling. In fact, it is often necessary for two or more operators to coordinate their efforts in lifting the quench stack for coupling, resulting in lost work time. It is, therefore, desirable to provide a mechanical assist in the lifting of the quench stack to remove the strain heretofore placed on the operators and to permit the ready coupling of the members by a single operator.

Also, due to the weight of the quench stack, it has heretofore been necessary to use four clamps to connect the quench stack and monomer ring. It is, therefore, desirable to develop a clamp which is so strong that its use in conjunction with the desired mechanical assist would readily replace the four prior art clamps to thereby reduce the number of physical acts, i.e., clamps to be connected, required by the operator.

Such devices would naturally have great utility outside of the melt spinning process. There are prior art devices which accommodate variations in dimensional distances between the two halves of the coupling device, e.g., U.S. Pat. No. 3,127,205 to Griffith et al., and U.S. Pat. No. 4,049,301 to Schenk. However, none of these devices meets the strength and variation requirements of the as-described application. And none of these devices also incorporates and assists in bringing the to-be-coupled members into proximity for coupling. These problems, unresolved by the prior art, are effectively eliminated by the present invention.

SUMMARY OF THE INVENTION

The present invention provides apparatus for bringing into proximity and connecting (or coupling) a first member and a second member. The apparatus comprises as its major elements first and second keeper elements, a reel assembly, and a clamp.

The first keeper element is to be mounted on one of the members. The reel assembly comprises a reel and a cable. The reel, which is biased to retract, is to be mounted on the other of the members. The cable is engageable at one end to the first keeper element and is fastened at its other end to and retracts by means of the reel.

The second keeper element is also to be mounted on one of the members. The clamp, which is to be mounted on the other of the members, comprises a drawpiece. The drawpiece comprises at least one leg which is formed of a rod and which has a catch at one end thereof. The leg, which terminates at its other end in means for mounting to the clamp, describes a coil intermediate to its two ends. The catch is engageable with the second keeper element to connect the members when the members are brought into proximity by the cable retracting by means of the reel.

While preferably used in conjunction with one another, the clamping device and reel assembly have utility independent of one another.

The clamping device of the present invention features a novel drawpiece. The drawpiece, which is used in conjunction with the clamp and a keeper element, comprises a rod which forms at least one leg. The leg has a catch for engaging with the keeper element and describes a coil.

The reel assembly is used to bring into proximity for connection two members which together form a chamber, one of the members having mounted thereto a keeper element. The reel assembly comprises a reel and a cable. The reel, which is biased to retract, is mounted to the other of the two members. The cable is connected at one end to the keeper element and is fastened at its other end to and retracts by means of the reel. The members are brought into proximity for connection when the cable is urged to retract.

The invention will be more clearly understood and additional objects and advantages will become apparent upon reference to the discussion below and to the drawings which are given for illustrative purposes.

DESCRIPTION OF THE PREFERRED EMBODIMENT

Figure 1:
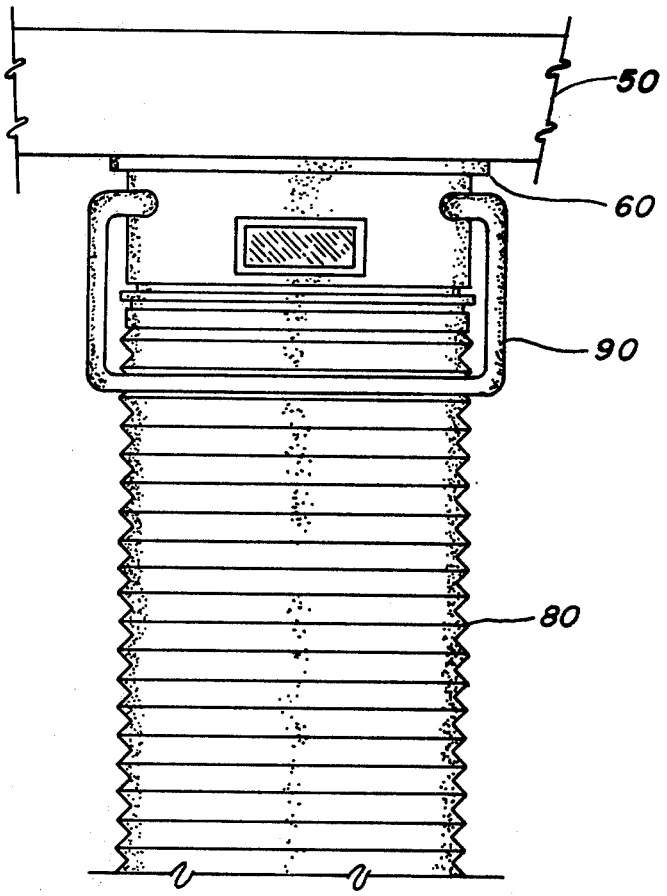
FIG. 1 (PRIOR ART)
FIG. 1 is a front view showing a fiber melt extrusion and quench apparatus of the prior art.

In the accompanying drawings, like numbers indicate like apparatus. With reference to FIG. 1, the spinning apparatus with which the present invention is utilized is shown. Quench stack 80 is positioned downstream of monomer ring 60 with a sealing member, e.g., a silicone seal, therebetween (unshown). Monomer ring 60 is attached to spinning block 50 immediately thereabove. Spinning block 50 includes at least one spinnerette (unshown) through which filaments are extruded. The extruded filaments pass through monomer ring 60 into quench stack 80 for quenching and thence to takeup means or further processing equipment (unshown). In order to provide for periodic inspection and maintenance of the spinnerette and monomer ring 60, quench stack 80 and monomer ring 60 can be disconnected. Quench stack 80 then drops downwardly from monomer ring 60.

Figure 2:
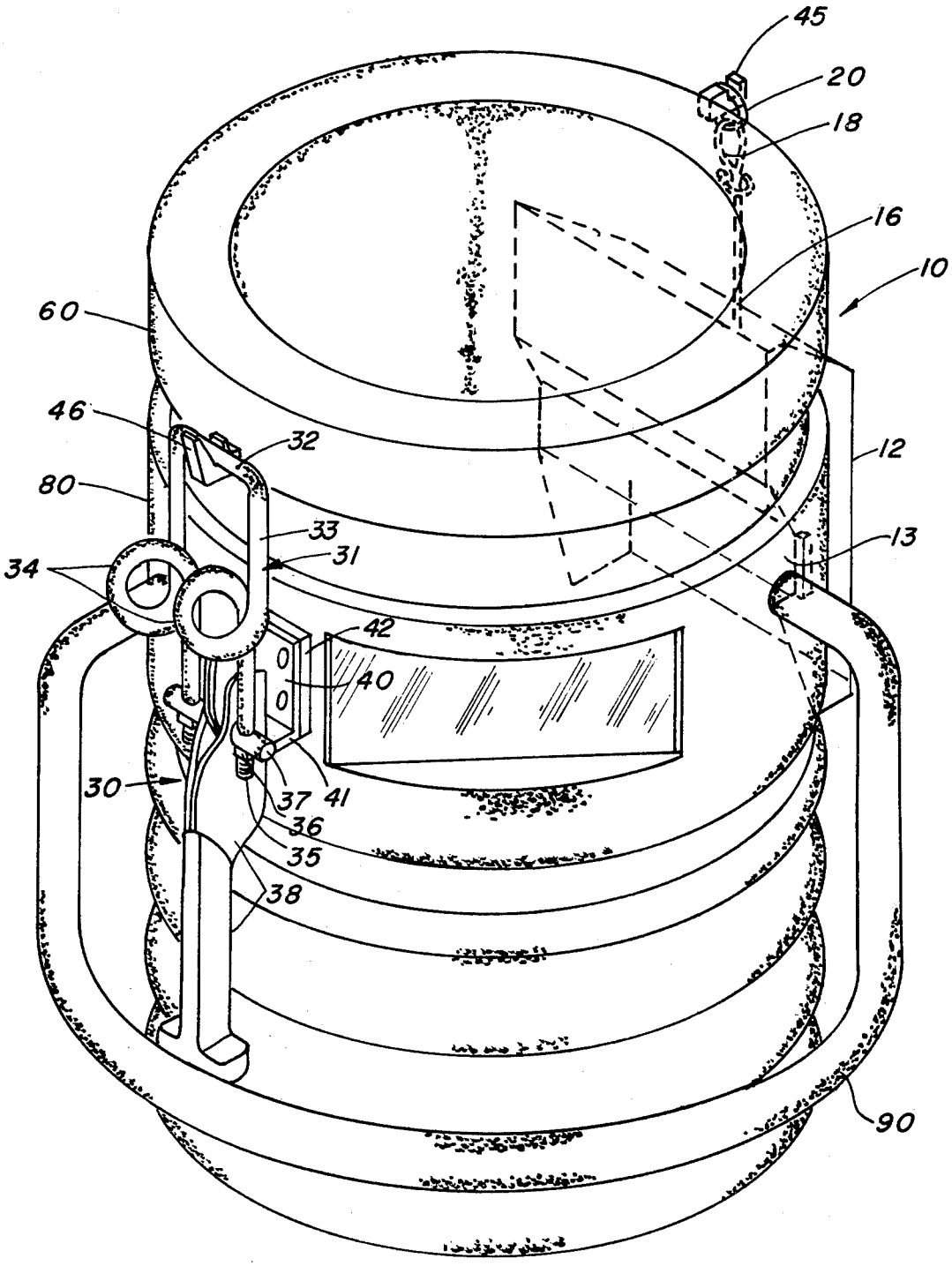
FIG. 2 is a graphic, isometric view of a monomer ring and quench stack in their operating position utilizing the clamping device and reel assembly of the present invention.
Figure 6:
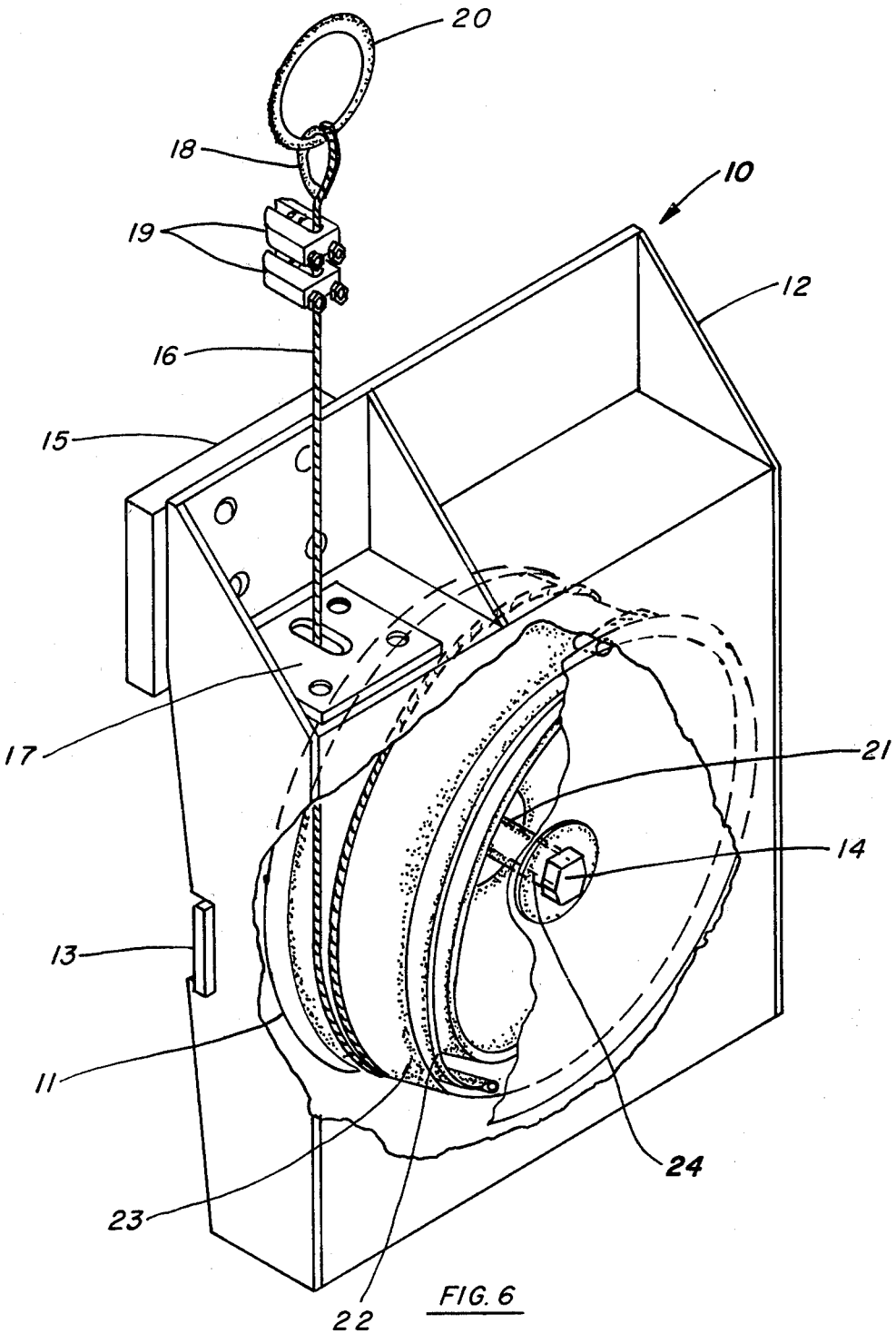
FIG. 6 is a graphic, isometric view of the reel assembly of the present invention.

FIG. 6 depicts reel assembly 10 which comprises part of the present invention, and FIG. 2 shows reel assembly 10 as utilized in the preferred embodiment. The first keeper element 45, shown as a hook, is mounted on the exterior of monomer ring 60. Reel assembly 10 comprises as its major elements a reel 11 and cable 16.

Reel 11 is sheltered by and mounted in the housing 12, which in turn is mounted to quench stack 80 by means of a quench stack pad 15 located therebetween. Housing 12 is shaped like a box, a lower side and one face of which is missing or open. The open face of housing 12 is adjacent to quench stack 80 when housing 12 is mounted thereto. Extending across the open face of housing 12 is a rectangular plate 13. Reel 11 is mounted in housing 12 with its flanges parallel to and between rectangular plate 13 and the opposing face of housing 12; a square rod 24 is passed through the core 21 of reel 11 to be fixed in rectangular plate 13 and the opposing face of housing 12 with studs 14. This prevents rotation of core 21 while permitting rotation of the flanges of reel 11. A coil spring 22 is attached at one end to stationary core 21 of reel 11 and is anchored at its other end to a flange of reel 11. This permits the prewinding of reel 11 to a desired lifting force. A cylinder 23 is mounted concentric to stationary core 21 and with its sides fixed in the flange of reel 11. Cylinder 23 essentially houses coil spring 22 and stationary core 21 and provides a surface on which cable 16 can wind.

Cable 16 is fastened at one end to one of the flanges of reel 11 to rotate therewith and winds on cylinder 23 in the opposite direction to the coiling of coil spring 22 about stationary core 21 (see FIG. 6). Cable 16 passes from reel 11 upwardly through a cable guide 17 located in the roof of housing 12. Cable guide 17 has a slot therein for passage of cable 16, the length dimension of the slot approximately paralleling the width dimension of reel 11. Cable 16 is looped at its other end through a ring 20 which links with the first keeper element 45 mounted to monomer ring 60 (see FIG. 2). The loop formed by cable 16 is secured by a pair of clamps 19 to prevent slippage of cable 16 when quench stack 80 is lowered. The looped portion of cable 16 has a thimble 18 within the loop to protect cable 16 from forming a sharp crease or fracturing as it passes over ring 20.

Reel assembly 10 operates as follows. With ring 20 linked over the hook comprising first keeper element 45, quench stack 80 and monomer ring 60 are disconnected. Quench stack 80 drops vertically, and cable 16, which is wound on reel 11, pays out. Reel 11, which is already prewound to a particular lifting force, has more force, biased toward creating the cable 16 to wind up, put thereon (via the further coiling of coil spring 22) to increase the lifting force as quench stack 80 drops. To bring quench stack 80 back into proximity with monomer ring 60 to permit their reconnection, an operator simply lifts up on lift bar 90. Reel 11 assists in the lifting due to the fact that it is spring loaded to retract with a lifting force capable of lifting quench stack 80, in this case a lifting force of 57 pounds. As quench stack 80 is lifted, reel 11 retracts cable 16 by winding.

Materials of construction can be any materials known to be suitable by one skilled in the art but are preferably as follows: Housing 12 and plate 13 are fabricated of material which is temperature resistant and possesses high strength properties,, e.g, a metal; aluminum is preferred due to its lightness. Reinforced plastics, while feasible, are cost prohibitive and more likely to deform due to the temperature encountered at quench stack 80. Reel 11 is fabricated of metal, preferably a mild steel. With respect to cable guide 17, the area immediately surrounding the slot, and preferably the entire part, is formed of a nonabrasive material to prevent damage to the cable 16. Thus, a nonmetallic material such as plastic, e.g., nylon is preferred. Cable 16 is preferably formed by sheathing a nylon impregnated flexible wire with Teflon tubing, the characteristics mandated of the cable being high strength, an exterior with a melt temperature higher than the polymer constituent of the extruded filament (to preserve the cable's integrity should the filaments be blown thereagainst when quench stack 80 is lowered), and an exterior which is slick (to prevent sticking of the filaments to the cable in the event they are blown thereagainst when quench stack 80 is lowered). Thimble 18 can comprise a thin metal casting of rolled stock, and ring 20 is preferably formed of a metal such as steel. Clamps 19 can be standard metal castings.

Figure 3:
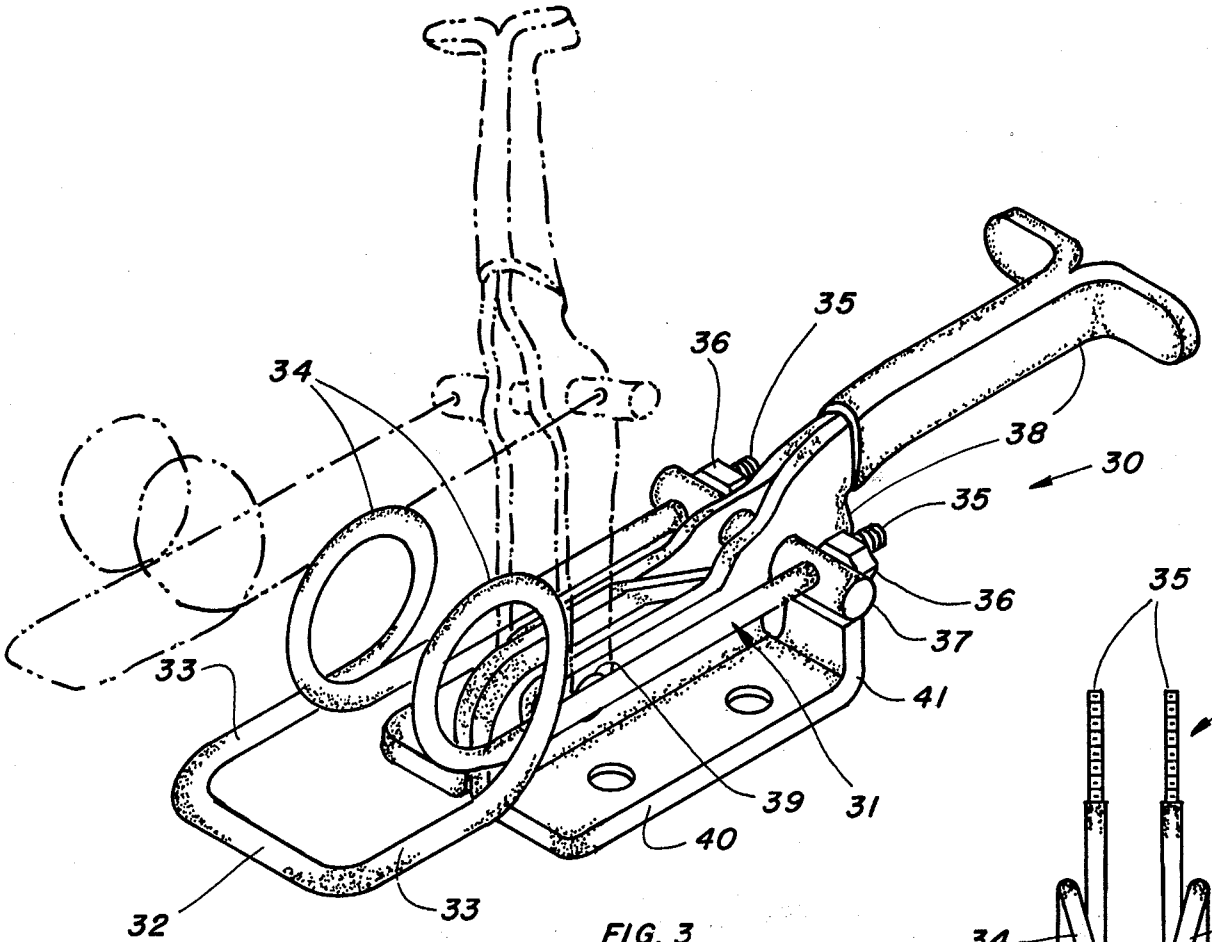
FIG. 3 is a graphic, isometric view of the clamping device of the present invention in the clamped position, the unclamped position being shown in phantom.

FIG. 3 depicts clamping device 30 which comprises part of the present invention, and FIG. 2 shows clamping device 30 as utilized in the preferred embodiment.

Lever 38 is pivotally mounted at one end to clamp base 40 by means of pivot pin 39 which passes through aligned holes in the adjacent legs of the two angles forming clamp base 40. Lever 38 forms a handle at its other end which may be sheathed, as shown, with an insulating material. A second pivot pin 37 passes through lever 38 at a point intermediate to the two ends of lever 38. Second pivot pin 37, the axis of which is parallel to that of pivot pin 39, has, on either side of lever 38, a hole therethrough which is perpendicular to the axis of pin 39 for passage of threaded shanks 35 of drawpiece 31.

Figure 5:
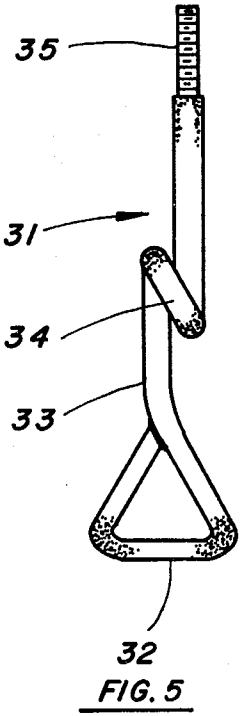
FIG. 5 is a plan view of an alternate drawpiece.
Figure 4:
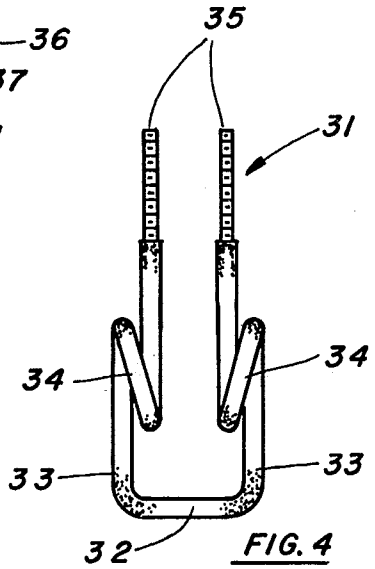
FIG. 4 is a plan view of a drawpiece for use in conjunction with a clamp or clamping device.

With reference to FIGS. 3, 4, and 5, drawpiece 31 comprises a rod which, in the preferred embodiment, is circular in cross-section and curved into a "U" shape. The base of the "U" forms a catch 32 which engages with second keeper element 46. Each of the legs 33 of the "U" describes a coil 34 prior to terminating in a threaded shank 35. Threaded shanks 35 are closely fit through the holes in pivot pin 37 and are held in place by lock nuts 36. Lock nuts 36 additionally function as stops to prevent the withdrawal of pivot pin 37 from lever 38. Clamp base 40 can function as a mounting bracket and is so utilized in the preferred embodiment wherein clamping device 30 is mounted to quench stack 80 by welding or bolting clamp base 40 thereto.

With the exception of drawpiece 31, clamping device 30 is a conventional over-the-center toggle locking action clamp. The toggle locking action will be better understood by reference to FIG. 3. When clamping device 30 is in the clamped position, second pivot pin 37 rests on ears 41 of clamp base 40, and the central axis of second pivot pin 37 is slightly below that of first pivot pin 39. Lever 38 must be pivoted upwardly (see FIG. 3, phantom) to permit the pivotal disengagement of catch 32 and its corresponding keeper element (46 in the preferred embodiment). As lever 38 pivots, it moves the central axis of second pivot pin 37 up and over first pivot pin 39. In order to bring clamping device 30 back to the clamped position, drawpiece 31 is pivoted until catch 32 engages with its keeper element and then lever 38 is pivoted downwardly until second pivot pin 37 rests on ears 41 of clamp base 40.

With reference to FIG. 2, clamping device 30 is positioned so that catch 32 of drawpiece 31 is up when in the clamped position. Pad 42, welded to the head of quench stack 80, is provided for the bolting of clamp base 40 to the quench stack 80. Clamping device 30 is shown in the clamped position, catch 32 being linked over and engaging with second keeper element 46 and lever 38 being down. Reel assembly 10 is shown with ring 20 linked over first keeper element 45 and cable 16 pulled taut via the lifting force and retraction of reel 11. Monomer ring 60 and quench stack 80 are tightly clamped together for operation. To disconnect monomer ring 60 and quench stack 80, an operator pulls lever 38 out and up until catch 32 can be swung clear of second keeper element 46 (shown as a bracket with an upturned edge mounted on monomer ring 60). Quench stack 80 then drops vertically, reel assembly 10 functioning as previously described. If silicone salve is used as the sealing member (placed in a groove formed in the upper rim of quench stack 80), its exposure at this point to lower than processing temperatures will cause it to cool in whatever shape it has assumed. If a silicone rubber gasket is used as the sealing member (and placed in the same groove of quench stack 80 as the salve would have been), it is possible that after repeated use it will be subject to heat distortion and/or deformation. In either case, it will be necessary in reconnecting quench stack 80 and monomer ring 60 to provide some means which will exert a converging force on the two members to provide the most effective seal therebetween possible. This is achieved in the following manner. An operator lifts lift bar 90 to bring quench stack 80 back into proximity with monomer ring 60, as previously described. Catch 32 of drawpiece 31 is linked over second keeper element 46, and lever 38 is pulled down into the clamping position. At this point, the most effective seal possible is achieved, considering the coolness of the sealing member. The drawing force exerted by coils 34 and the lifting force of reel assembly 10 continuously urge quench stack 80 up against monomer ring 60. After the melt spin process has resumed, operating temperatures will soften or plasticize a salve seal to permit quench stack 80 to be drawn up as tightly as possible against monomer ring 60.

Drawpiece 31 is the unique feature of clamping device 30 and can be used with clamps other than as described, for instance with a clamp having under-the-center toggle locking action. The preference for an over-the-center toggle clamp is chiefly due to the equipment restraints of the melt spin process embodiment. Further, clamping device 30 has utility outside of the melt spin process.

Drawpiece 31, as shown in FIGS. 4 and 5, comprises a rod which forms at least one leg 33, leg 33 having a catch 32 and describing a coil 34. The rod is preferably made of a high alloy metal which is extremely strong and temperature resistant, e.g., a high alloy steel such as nickel cobalt. The rod is preferably circular in cross-section although a polygonal cross-section is equally suitable if it approximates a regular polygon. For instance, if the rod is rectangular in cross-section, the rectangle must approximate a square, and if the rod is triangular in cross-section, the triangle must approximate an equilateral triangle. This is necessary due to the coil 34 which the rod must be bent to form. The angle which must be put on the rod to form coil 34 is difficult to achieve with sheet metal which would easily distort.

In the preferred embodiment (FIGS. 3 and 4), the rod is curved into a "U" shape with the base of the "U" forming a catch 32 which engages with a keeper element. Alternative catches can be formed and utilized, e.g., by forming the end of the rod into a hook or by placing a hook at the catch area of the rod. Each of the legs 33 of the "U"-shaped rod describes a coil 34 prior to terminating in a threaded shank 35 for mounting to a clamp. Alternative mounting methods can be utilized. For example, drawpiece 31 can be rectangular in shape with two of the rectangle's opposing sides forming legs 33 (which describe coils 34) and the other two opposing sides forming, respectively, a catch 32 or catch-receiving member and a clamp mounting member. The mounting member can be utilized in lieu of pivot pin 37 (see FIG. 3) with appropriate, accomodating modifications to the clamp. Coil 34 is preferably a single circle bend of the rod's leg 33, and the ratio of the mean diameter of the circle bend to the diameter of the rod ranges from 2 to 10. Where the cross-section of the rod is other than circular, i.e., polygonal, then the diameter of the rod is considered to be the diameter of the circle which is inscribable in the polygon.

A perfectly straight drawpiece cannot take up a variation in distance between the two members which are connected by a clamping device incorporating such a drawpiece; however, a drawpiece which describes a coil or circle bend can. An increase in the mean diameter of the circle bend of such a drawpiece without a corresponding increase in the diameter of the rod, i.e., an increase in ratio, creates a drawpiece which can take up a greater variation in distance between the two members which are clamped but which has a weaker pulling or drawing force. Conversely, a decrease in the mean diameter of the circle bend without a corresponding decrease in the diameter of the rod, i.e., a decrease in ratio, creates a drawpiece which has a greater pulling or drawing force but which can take up less variation in distance. Thus, depending on the particular end use or application, drawpieces with different ratios will be more or less desirable. In the clamping of quench stack 80 to monomer ring 60, a ratio of between 3 and 5 is most preferable. On the other hand, where it is desirable to clamp together machined parts having closer tolerances, less take-up variation and greater pulling or drawing force is desirable and thus, a smaller ratio is more suitable. Any application requiring greater take-up variation and weaker drawing or pulling force can utilize a drawpiece having a greater ratio. Greater variation can also be achieved by increasing the number of circle bends, but there will be a corresponding decrease in pulling or drawing force. Plural bends in the same leg are also less preferable since a drawpiece with the desired variation in force can be formed having a single circle bend or coil; such a single-coil drawpiece is more compact and requires less material to make and is therefore more desirable.

An alternate embodiment of drawpiece 31 is depicted in FIG. 5. There, a rod is shaped to form a catch 32 with only one leg 33 which describes a coil 34. Catch 32 is formed by bending the rod into a triangle for engagement with a keeper element. Alternate catches can be formed, e.g., by bending the end of the rod into a hook or placing a hook at the catch area of the rod. Obviously, such a drawpiece will necessarily be mounted to a slightly modified clamp for use. The drawpiece of either embodiment is preferably heat treated subsequent to its formation in order to increase its mechanical properties.

Returning to the use of clamping device 30 in conjunction with reel assembly 10 to bring into proximity and connect quench stack 80 to monomer ring 60, it is preferred that clamping device 30 and reel assembly 10 be mounted on quench stack 80 in diametric opposition to one another. If otherwise offset or centered, sagging and lack of effective sealing may occur and result in leaking. It should be noted that where four clamps (with conventional drawpieces) were previously required to connect these members, only reel assembly 10 and clamping device 30 are now necessary. However, it is possible to use more than one clamping device 30 in this particular application; if this is done, the clamping devices and reel assembly are preferably approximately equi-spaced on the periphery of quench stack 80.

In this disclosure, there is shown and described only the preferred embodiment of the invention, but it is to be understood that the invention is capable of other and different embodiments, and its several details are capable of various obvious modifications, all without departing from the inventive spirit thereof. It is intended that this invention be limited only as set forth in the following claims.

What is claimed is:

1. Apparatus for bringing into proximity and connecting a quench stack and the apparatus next upstream of said quench stack, comprising:

(A) a first keeper element, which is mounted on said upstream apparatus;

(B) a reel assembly, comprising:

(1) a reel which is biased to retract and which is mounted to said quench stack;

(2) a cable, which is engageable at one end to said first keeper element and which is fastened at its other end to and which retracts by means of said reel;

(C) a second keeper element, which is mounted on said upstream apparatus; and (D) a toggle clamp, which is mounted on said quench stack and which comprises a drawpiece, said drawpiece comprising a rod which is curved into a "U" shape, the base of which engages with said second keeper element, each of the legs of said "U"-shaped rod describing a circle bend prior to terminating in a threaded shank for mounting to said clamp, said rod approximating a circle in cross-section, the ratio of the mean diameter of said circle bend to the diameter of said rod ranging from 3 to 5.

2. Apparatus for bringing into proximity and connecting a first member and a second member, one of said members being a quench stack and one of said members being the apparatus next upstream of said quench stack, each of said members forming individual chambers which when brought into proximity and connected form a larger chamber, said apparatus comprising:

(A) a first keeper element, which is to be mounted on one of said members;

(B) a reel assembly, comprising:

(1) a reel, which is biased to retract and which is to be mounted to the other of said members; and (2) a cable, which is engageable at one end to said first keeper element and which is fastened at its other end to and which retracts by means of said reel;

(C) a second keeper element, which is to be mounted on one of said members; and (D) a clamp, which is to be mounted on the other of said members and which comprises a drawpiece, said drawpiece comprising at least one leg, said leg being formed of a rod and having a catch at one end thereof, said leg terminating at its other end in means for mounting to said clamp, said leg describing a coil intermediate to its said ends, said catch being engagable with said second keeper element to connect said members when said members are brought into proximity by said cable retracting by means of said reel.

3. Apparatus for bringing into proximity for connection two members which together form a chamber, one of said members being a quench stack and one of said members being the apparatus next upstream of said quench stack, one of said members having mounted thereto a keeper element, said apparatus comprising:

(A) a reel, biased to retract and mounted to the other of said members; and (B) a cable, connected at one end to said keeper element and fastened at its other end to and retracting by means of said reel; whereby said members are brought into proximity for connection when said cable is urged to retract.

4. The apparatus of claim 3 wherein the apparatus next upstream of said quench stack is a monomer ring.

* * * * *